US009429174B1

(12) United States Patent
Schuh et al.

(10) Patent No.: US 9,429,174 B1
(45) Date of Patent: Aug. 30, 2016

(54) ENABLING VALVE HAVING SEPARATE FLOAT AND LIFT DOWN POSITIONS

(71) Applicants: Scott N. Schuh, Bismarck, ND (US); Joseph A. St. Aubin, Wahpeton, ND (US); William B. Coykendall, Lisbon, ND (US)

(72) Inventors: Scott N. Schuh, Bismarck, ND (US); Joseph A. St. Aubin, Wahpeton, ND (US); William B. Coykendall, Lisbon, ND (US)

(73) Assignee: Clark Equipment Company, West Fargo, ND (US)

( * ) Notice: Subject to any disclaimer, the term of this patent is extended or adjusted under 35 U.S.C. 154(b) by 339 days.

(21) Appl. No.: 14/215,974

(22) Filed: Mar. 17, 2014

Related U.S. Application Data

(60) Provisional application No. 61/793,845, filed on Mar. 15, 2013.

(51) Int. Cl.

| | |
|---|---|
| ***F15B 13/04*** | (2006.01) |
| ***F15B 11/00*** | (2006.01) |
| ***E02F 3/42*** | (2006.01) |
| ***E02F 9/22*** | (2006.01) |

(52) U.S. Cl.
CPC ..... *F15B 11/003* (2013.01); *E02F 3/422* (2013.01); *E02F 9/2203* (2013.01); *F15B 2211/3127* (2013.01)

(58) Field of Classification Search
CPC ..... E02F 3/422; E02F 9/2203; F15B 2211/3127; F15B 2211/7741
See application file for complete search history.

(56) References Cited

U.S. PATENT DOCUMENTS

| | | | | |
|---|---|---|---|---|
| 3,908,515 | A * | 9/1975 | Johnson | F15B 13/01 91/445 |
| 4,418,612 | A * | 12/1983 | Nanda | F15B 13/015 91/445 |
| 5,467,829 | A | 11/1995 | Barton et al. | |
| 5,678,470 | A | 10/1997 | Koehler et al. | |
| 5,878,363 | A | 3/1999 | Koehler | |
| 5,907,991 | A * | 6/1999 | Ramamoorthy | E02F 9/2203 91/436 |
| 5,960,695 | A | 10/1999 | Aardema et al. | |
| 6,050,090 | A | 4/2000 | Tohji | |
| 6,389,953 | B1 | 5/2002 | Altman et al. | |
| 6,457,487 | B1 * | 10/2002 | Stephenson | F15B 11/042 91/448 |
| 6,951,067 | B1 | 10/2005 | Dietz et al. | |
| 7,168,229 | B1 | 1/2007 | Hoffman et al. | |
| 7,357,064 | B2 | 4/2008 | Kauss | |
| 7,549,241 | B2 | 6/2009 | Ioku et al. | |
| 8,544,378 | B2 * | 10/2013 | Kim | E02F 9/2203 91/445 |
| 2009/0057045 | A1 | 3/2009 | Stromberg et al. | |

* cited by examiner

*Primary Examiner* — Michael Leslie
(74) *Attorney, Agent, or Firm* — John D. Veldhuis-Kroeze; Westman, Champlin & Koehler, P.A.

(57) ABSTRACT

Disclosed is a power conversion system for controlling the flow of a hydraulic power signal between a power source and a hydraulic actuator having first and second ports. The power conversion system includes a control valve that is configured to selectively expose each of the first and second ports to one of the power source and a low pressure reservoir. An enabling valve having a disabled position, a first enabled position, and a second enabled position receives an input from the control valve and provides an output to the hydraulic actuator.

13 Claims, 3 Drawing Sheets

ENABLING VALVE HAVING SEPARATE FLOAT AND LIFT DOWN POSITIONS

CROSS-REFERENCE TO RELATED APPLICATION

This application claims the benefit of U.S. Provisional Application No. 61/793,845, which was filed on Mar. 15, 2013.

BACKGROUND

The present application is directed toward power machines. More particularly, the present application is directed toward hydraulic control valve arrangements that provide power signals to work elements such as lift arms. Power machines, for the purposes of this disclosure, include any type of machine that generates power for the purpose of accomplishing a particular task or a variety of tasks. One type of power machine is a work vehicle. Work vehicles are generally self-propelled vehicles that have a work device, such as a lift arm (although some work vehicles can have other work devices) that can be manipulated to perform a work function. Work vehicles include loaders, excavators, utility vehicles, tractors, and trenchers, to name a few examples.

Certain types of power machines with lift arms have hydraulic actuators (often hydraulic cylinders) that selectively provide power to move the lift arm in generally upward or downward directions in response to command signals generated by the operator. In many of these types of power machines, a proportional directional control valve allows hydraulic fluid to enter one end of a cylinder and exit the other end of the cylinder at a rate commanded by the operator. Control valves of this type are normally configured to prevent hydraulic fluid from being introduced into either end of the cylinder when an operator is not generating a command signal.

In some situations, the control valve is configured to allow hydraulic fluid to be evacuated from each end of the actuator, thereby allowing the lift arm to be controlled by gravity, with only engagement of an uneven terrain by an implement attached to the lift arm to allow the lift arm to be raised over a lowered position. Such a condition is known as a float condition, in that the lift arm is allowed to float up and down relative to the frame of the machine without any power, often in the form of pressurized hydraulic fluid, being provided to the actuator.

The discussion above is merely provided for general background information and is not intended to be used as an aid in determining the scope of the claimed subject matter.

SUMMARY

In one embodiment, a power machine is disclosed. The power machine includes a frame, a work element operably coupled to the frame, a hydraulic actuator coupled to the work element and operable to move the work element relative to the frame, and power source capable of providing a hydraulic power signal as an output. A power conversion system controls the flow of the hydraulic power signal between the power source and the hydraulic actuator. The power conversion system has a control valve and an enabling valve. The control valve is capable of determining a direction of flow between the power conversion system and the actuator. The enabling valve is movable between a first enabling valve position in which flow between the control valve and the actuator is blocked, a second enabling valve position that allows substantially unrestricted flow between the control valve and the actuator, and a third enabling valve position that allows a restricted flow between the control valve and the actuator.

In another embodiment, a power conversion system for controlling the flow of a hydraulic power signal between a power source and a hydraulic actuator having first and second ports is disclosed. The power conversion system includes a control valve configured to selectively expose each of the first and second ports to one of the power source and a low pressure reservoir, and an enabling valve having a disabled position, a first enabled position, and a second enabled position, the enabling valve receiving an input from the control valve an providing an output configured to be provided to the hydraulic actuator.

This Summary and the Abstract are provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DETAILED DESCRIPTION

Before the concepts of the present application are disclosed and described in the form of the embodiments set forth below, it is to be understood that the concepts discussed herein are not limited in their application to the details of construction and the arrangement of components set forth in the following description or illustrated in the following drawings. The disclosed concepts are capable of being practiced in other embodiments. In addition, the phraseology and terminology used herein is for the purpose of description and should not be regarded as limiting. The use of "including," "comprising," or "having" and variations thereof herein is meant to encompass the items listed thereafter and equivalents thereof as well as additional items.

The present application discloses a hydraulic control circuit for operating hydraulic functions for a power machine. More particularly, the present application discloses a hydraulic circuit for controlling the rate of change of evacuation of hydraulic fluid from an actuator under certain circumstances, as described below.

Figure 1:
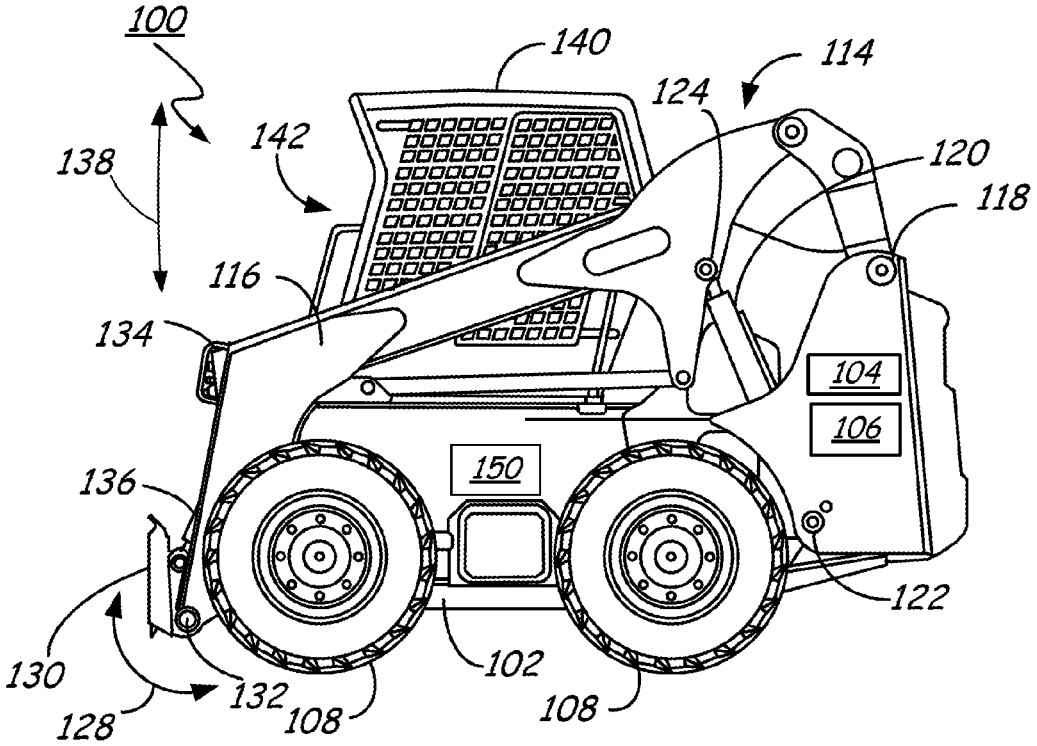
FIG. 1 is side elevation view of power machine of the type in which a control valve assembly described herein can be advantageously employed.
Figure 2:
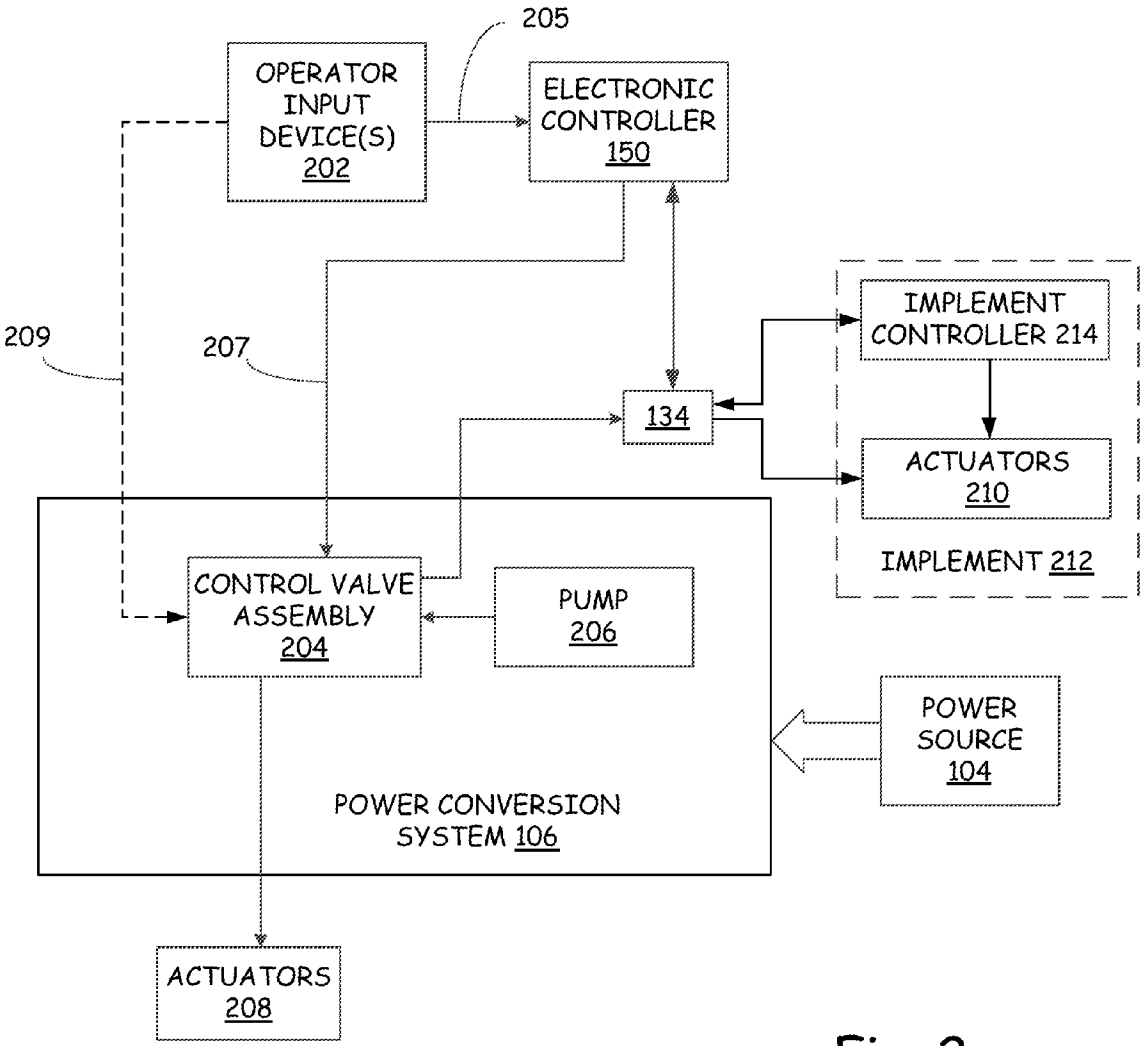
FIG. 2 is a block diagram illustrating functional systems of a representative power machine on which embodiments of the present disclosure can be practiced.

FIG. 1 is a side elevation view of a representative power machine 100 upon which the disclosed embodiments can be employed. FIG. 2 is a block diagram illustrating certain function systems of the power machine 100. The power machine 100 illustrated in FIG. 1 is a skid-steer loader, but other types of power machines such as tracked loaders, steerable wheeled loaders, including all-wheel steer loaders, excavators, telehandlers, walk behind loaders, trenchers, and utility vehicles, to name but a few examples, may employ the disclosed embodiments. The power machine or loader 100 includes a supporting frame or main frame 102, which supports a power source 104, which in some embodiments is an internal combustion engine. A power conversion system 106 is operably coupled to the power source 104. Power conversion system 106 illustratively receives power from the power source 104 and operator inputs to convert the received power to power signals in a form that is provided to and utilized by functional components of the power machine.

Some embodiments of power machines, such as loader 100 in FIG. 1, the power conversion system 106 includes hydraulic components such as one or more hydraulic pumps and various actuators and valve components that are illustratively employed to receive and selectively provide power signals in the form of pressurized hydraulic fluid to some or all of the actuators used to control work elements on the power machine. For example, a control valve assembly 204 (shown in FIG. 2) can be used to selectively provide pressurized hydraulic fluid from a hydraulic pump 206 (shown in FIG. 2) to actuators 208 (shown in FIG. 2) such as hydraulic cylinders that are positioned on the power machine. In some embodiments, control valve assembly 204 also selectively provides pressurized hydraulic fluid to actuators 210 located on an implement 212 attached to the power machine. Other types of control systems are contemplated. For example, the power conversion system 106 can include electric generators or the like to generate electrical control signals to power electric actuators. For the sake of simplicity, the actuators discussed in the disclosed embodiments herein are referred to as hydraulic or electrohydraulic actuators, but other types of actuators can be employed to control some work elements.

Among the work elements that are capable of receiving power signals from the power conversion system 106 are tractive elements 108, illustratively shown as wheels, which are configured to rotatably engage a support surface to cause the power machine to travel. Other examples of power machines can have tracks or other tractive elements instead of wheels. In an example embodiment, a pair of hydraulic motors (not shown in FIG. 1), are provided to convert a hydraulic power signal into a rotational output. In power machines such as skid steer loaders, a single hydraulic motor can be operatively coupled to both of the wheels on one side of the power machine. Alternatively, a hydraulic motor can be provided for each tractive element in a machine. In a skid steer loader, steering is accomplished by providing unequal rotational outputs to the tractive element or elements on one side of the machine as opposed to the other side. In some power machines, steering is accomplished through other means, such as, for example, steerable axles.

The loader 100 also includes a work element in the form of a lift arm structure 114 that is capable of being raised and lowered with respect to the frame 102. The lift arm structure 114 illustratively includes a lift arm 116 that is pivotally attached to the frame 102 at attachment point 118. An actuator 120, which in some embodiments is a hydraulic cylinder configured to receive pressurized fluid from power conversion system 106, is pivotally attached to both the frame 102 and the lift arm 116 at attachment points 122 and 124, respectively. Actuator 120 is sometimes referred to as a lift cylinder, and is a representative example of one type of actuator 208 shown in FIG. 2. Extension and retraction of the actuator 120 causes the lift arm 116 to pivot about attachment point 118 and thereby be raised and lowered along a generally vertical path indicated approximately by arrow 138. The lift arm 116 is representative of the type of lift arm that may be attached to the power machine 100. The lift arm structure 114 shown in FIG. 1 includes a second lift arm and actuator disposed on an opposite side of the of the power machine 100, although neither is shown in FIG. 1. Other lift arm structures, with different geometries, components, and arrangements can be coupled to the power machine 100 or other power machines upon which the embodiments discussed herein can be practiced without departing from the scope of the present discussion.

An implement carrier 130 is pivotally attached to the lift arm 116 at attachment point 132. One or more actuators such as hydraulic cylinder 136 are pivotally attached to the implement carrier and the lift arm structure 114 to cause the implement carrier to rotate under power about an axis that extends through the attachment point 132 in an arc approximated by arrow 128 in response to operator input. In some embodiments, the one or more actuators pivotally attached to the implement carrier and the lift arm assembly are hydraulic cylinders capable of receiving pressurized hydraulic fluid from the power conversion system 106. In these embodiments, the one or more hydraulic cylinders 136, which are sometimes referred to as tilt cylinders, and are further representative examples of actuators 208 shown in FIG. 2. Although no implements are shown as being attached to the power machine 100 in FIG. 1, the implement carrier 130 is configured to accept and secure any one of a number of different implements (e.g., implement 212 shown in FIG. 2) to the power machine 100 as may be desired to accomplish a particular work task. The types of implements that can be operably coupled to loader 100 or other similar power machines can range from simple implements such as buckets to complex implements.

A partial list of the types of implements that can be attached to the implement carrier 130 includes augers, planers, graders, combination buckets, wheel saws, and the like. These are only a few examples of the many different types of implements that can be attached to power machine 100. The power machine 100 provides a source, accessible at connection point 134, of power and control signals that can be coupled to an implement to control various functions on such an implement, in response to operator inputs. In one embodiment, connection point 134 includes hydraulic couplers that are connectable to the implement 212 for providing power signals in the form of pressurized fluid provided by the power conversion system 106 for use by an implement that is operably coupled to the power machine 100. Alternatively or in addition, connection point 134 includes electrical connectors that can provide power signals and control signals to an implement to control and enable actuators of the type described above to control operation of functional components on an implement. Actuation devices 210 located on an implement are controllable using control valve assembly 204 of power system 106.

Power machine 100 also illustratively includes a cab 140 that is supported by the frame 102 and defines, at least in part, an operator compartment 142. Operator compartment 142 typically includes an operator seat (not shown in FIG. 1) and operator input devices 202 (shown schematically in FIG. 2) and display devices accessible and viewable from a sitting position in the seat. When an operator is seated properly within the operator compartment 142, the operator can manipulate operator input devices 202 to control such functions as driving the power machine 100, raising and lowering the lift arm structure 114, rotating the implement carrier 130 about the lift arm structure 114 and make power and control signals available to implement 212 via the sources available at connection point 134.

In some embodiments, an electronic controller 150 (shown in FIGS. 1 and 2) is configured to receive input signals from at least some of the operator input devices 202 and provide control signals to the power conversion system 106 and to implements via connection point 134. It should be appreciated that electronic controller 150 can be a single electronic control device with instructions stored in a memory device and a processor that reads and executes the instructions to receive input signals and provide output signals all contained within a single enclosure. Alternatively, the electronic controller 150 can be implemented as a plurality of electronic devices coupled on a network. The disclosed embodiments are not limited to any single implementation of an electronic control device or devices. The electronic device or devices such as electronic controller 150 are programmed and configured by the stored instructions to function and operate as described.

Referring now more particularly to FIG. 2, further features of power machine 100 are shown in block diagram form in accordance with exemplary embodiments. As shown, the one or more operator input devices 202 are operatively coupled to electronic controller 150 via a network 205 or other hard wired or wireless connection. The operator input devices 202 are manipulable by an operator to provide control signals to the electronic controller 150 via network 205 to communicate control intentions of the operator. The operator input devices 202 are to provide control signals for controlling some or all of the functions on the machine such as the speed and direction of travel, raising and lowering the lift arm structure 114, rotating the implement carrier 130 relative to the lift arm structure, and providing power and control signals to an implement to name a few examples. Operator input devices 202 can take the form of joystick controllers, levers, foot pedals, switches, actuable devices on a hand grip, pressure sensitive electronic display panels, and the like. In various power machines, some, all, or none of the work elements can be controlled by a controller 150. For example, a lift arm such as lift arm structure 114, in various embodiments, is controlled via electronics such as electronics controller 150. In other embodiments, work elements such as lift arms can be controlled via mechanical linkages (represented by arrow 209) from operator input devices 202 and control valve assembly 204.

In response to control signals generated by operator input devices 202, electronic controller 150 controls operation of control valve assembly 204 and actuators 208. In addition, electronic controller 150 can control actuators 210 on implement 212 or alternatively provide signals to an implement controller 214 that can, in turn, directly control one or more actuators 210 or provide control signals back to the electronic controller 150 to signal that control valve assembly 204 be actuated to provide hydraulic fluid to one or more of the actuators 210. Control of actuators 208 and 210 is, in at least some respects, performed using electrical signals on control lines or network 207 to control spool valves of control valve assembly 204 to selectively direct the flow of hydraulic fluid from pump 206 to those actuators. Flow of hydraulic fluid to actuators 210 on implement 212 is through hydraulic lines connected to the implement at connection point 134. Disclosed embodiments are described with reference to control of a control valve assembly 204 for selectively providing pressurized hydraulic fluid to actuators 208 on power machine 100, which can include lift cylinders 120 and tilt cylinders 136, and actuators 210 on implement 212 attached to implement carrier 130.

Figure 3:
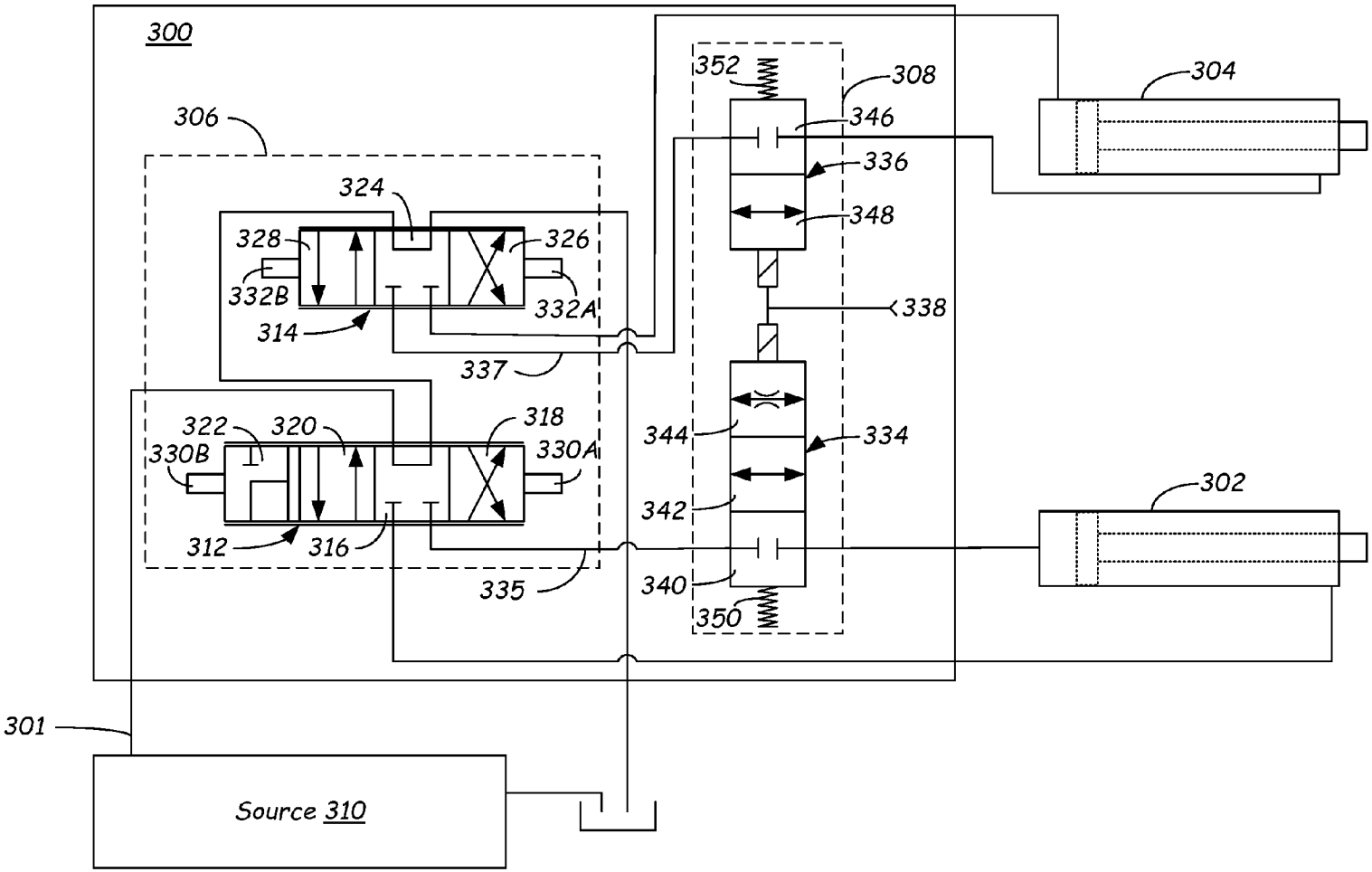
FIG. 3 is a block diagram of a hydraulic circuit including a power conversion system according to one illustrative embodiment.

FIG. 3 illustrates a portion of a power conversion system 300 for providing control signals to one or more lift cylinders 302 and tilt cylinders 304 according to one illustrative embodiment. The power conversion system 300 includes a control valve 306 and an enabling valve 308. The control valve 306 receives a power signal 301 from a source 310 in the form of pressurized hydraulic fluid. The source 310 can include one or more hydraulic pumps to provide the power signal 301. The control valve 306 includes a lift valve 312 and a tilt valve 314. The lift valve 312 is a four-position valve, operable between a neutral position 316, lift up position 318, lift down position 320 and float position 322. The tilt valve 314 is a three-position valve including a neutral position 324, a curl position 326 and a dump position 328. The lift and tilt valve in this particular embodiment are variable spool valves, housed in a single housing. In other embodiments, the lift and tilt valves can be housed in separate housings or can be implemented using other types of valves besides spool valves.

The lift and tilt spool valves 312 and 314 are shown in FIG. 3 in a default position. The lift and spool valves 312 and 314 are biased to these default positions by biasing elements (not shown) such as biasing springs. Forces are selectively applied to the lift and tilt spool valves 312 and 314 to cause the lift and spool valves to move from the neutral positions 316 and 324 to the other positions as desired. The selectively applied forces can applied using various different types of actuators. For the purposes of illustration, actuation devices 330A and 330B are shown on either side of the lift spool 312 indicating two actuators for shifting of lift spool in either direction. In one embodiment a pair of electrohydraulic cartridges can be employed to selectively port pressurized hydraulic fluid against one end or the other of the lift spool 312. In alternate embodiments a single actuator, such as an electric drive mechanism or mechanical linkage from an operator input such as a hand or foot controlled device can engage the lift spool 312 to shift it from one position to another. Similarly, the tilt spool valve 314 can be controlled by a pair of actuators 332A and 332B or a single actuator similar to those discussed above with respect to the lift spool 312.

Outputs 335 and 337 are provided from the lift spool valve 312 and the tilt spool 314, respectively, to the enabling valve 308. The enabling valve 308 has a lift enabling valve 334 and a tilt enabling valve 336. The enabling valves receive an enabling signal 338 to shift them to an enabling position as discussed below. The lift enabling valve 334 has three positions, a blocking position 340, a first enabling position 342, and a second enabling position 344. The tilt enabling valve 336 has two positions, a blocking position 346 and an enabling position 348. As shown in this embodiment, the enabling valves are spool valves, but other types of valves can be used in alternative embodiments.

When the lift enabling valve 334 and the tilt enabling valve 336 are in their respective blocking positions, hydraulic fluid is incapable of passing from the control valve 306 to the actuators 302 and 304 and vice versa. The lift enabling valve 334 is biased to its blocking position 340 by biasing mechanism 350. Similarly, tilt enabling valve 336 is biased to its blocking position 346 by biasing mechanism 352. Because enabling valves are biased to a blocking position, an affirmative action is required to overcome the biasing mechanisms. The enabling valves thus prevent inadvertent or unwanted movement of the actuators 302 and 304.

The enabling signal 338 is provided to act against the biasing mechanisms 350 and 352. Enabling signal 338 can be an electrical signal, a hydraulic signal, or any other suitable signal capable of overcoming the biasing mechanisms. The enabling signal 338 is shown as a single signal provided to each of the lift enabling valve 334 and the tilt enabling valve 336. Alternatively, separate signals can be provided to the two enabling valves. As discussed above, the lift enabling valve 334 has two enabling positions 342 and 344. The second enabling position 344, as shown in FIG. 3, has a restriction in it to reduce the rate at which pressurized fluid is allow to flow therethrough. Thus, in situations where it is desirable to reduce flow rate during an enabling condition, the second enabling position 344 should be selected over the first enabling position. For example, when an operator wishes to power the lift arm on a power machine up or down in normal operating conditions, the first enabling position 342 will allow for relatively quick cycle times (i.e. the time it takes to raise and lower the lift arm) unimpeded by a restriction in the enabling valve. If, however, an operator wishes to use the float function of the lift arm to allow the lift arm to float over the surface of the ground, a restriction in the enabling valve will slow down movement of the lift arm. In one embodiment, the enabling signal 338 is in communication with the actuators 330A and 330B so that an increased level provided to actuator 330B to shift the lift spool into the float position is also provided to the enabling signal 338 to shift the lift enabling valve 334 into the second enabling position 344. In other embodiments, the signal 338 provided to lift enabling valve 334 is provided independently from the actuator 330B so that the lift enabling valve 334 can be controlled independently from the lift spool valve 316.

The embodiments above provide important advantages. Having enabling valves in series with control valves provides the ability to require an affirmative action to overcome a biasing member and enable flow to an actuator. By providing an enabling valve with a plurality of different enabled positions, various flow rates can be provided for without requiring modifications and additional complexity in a control valve.

Although the present invention has been described with reference to preferred embodiments, workers skilled in the art will recognize that changes may be made in form and detail without departing from the spirit and scope of the invention.

The invention claimed is:

1. A power machine comprising:

a frame;

a work element operably coupled to the frame;

a hydraulic actuator coupled to the work element and operable to move the work element relative to the frame;

a power source capable of providing a hydraulic power signal as an output; and a power conversion system for controlling the flow of the hydraulic power signal between the power source and the hydraulic actuator, the power conversion system having a control valve and an enabling valve, the control valve being capable of determining a direction of flow between the power conversion system and the actuator and the enabling valve being movable between a first enabling valve position in which flow between the control valve and the actuator is blocked, a second enabling valve position that allows substantially unrestricted flow therethrough, and a third enabling valve position that allows a restricted flow therethrough.

2. The power machine of claim 1, wherein the hydraulic actuator is a hydraulic cylinder and the control valve is moveable between first, second and third control valve positions, with the first control valve position being configured to allow the hydraulic power signal to flow to a first end of the hydraulic actuator with a second end of the hydraulic actuator being exposed to a low pressure reservoir, the second control valve position being configured to allow the hydraulic power signal to flow to the second end of the hydraulic actuator with the first end of the hydraulic actuator being exposed to a low pressure reservoir, the third control valve position being configured to allow both the first and the second ends of the hydraulic actuator to be exposed to a low pressure reservoir.

3. The power machine of claim 2, wherein the enabling valve is configured to be positioned in the second enabling valve position when the control valve is in the second control valve position and in the third enabling valve position when the control valve is in the third control valve position.

4. The power machine of claim 1 and further comprising an enabling signal for controlling the position of the enabling valve, the enabling signal being configured to urge the enabling valve between the first, second, and third enabling valve positions.

5. The power machine of claim 4, wherein the control valve is controlled by at least one actuation signal and wherein the enabling signal is in communication with at least one actuation signal.

6. A power conversion system for controlling the flow of a hydraulic power signal between a power source and a hydraulic actuator having first and second ports, comprising:

a control valve configured to selectively expose each of the first and second ports to one of the power source and a low pressure reservoir; and an enabling valve having a disabled position, a first enabled position, and a second enabled position, the enabling valve receiving an input from the control valve and providing an output configured to be provided to the hydraulic actuator.

7. The power conversion system of claim 6, wherein in the first enabled position, the enabling valve is configured to provide a substantially unrestricted flow path between the control valve and actuator and in the second enabled position, the enabling valve is configured to provide a restricted flow path between the control valve and actuator.

8. The power conversion system of claim 7, wherein the control valve has a first position in which the control valve is configured to expose one of the first and second ports of the control valve to the power source and a second position in which the control valve is configured to expose each of the first and second ports to the low pressure reservoir, and wherein when the control valve is in the first position, the enabling valve is in the first enabled position.

9. The power conversion system of claim 8, wherein the enabling valve is controlled such that it is prevented from being in the first enabling position when the control valve is in the second position.

10. The power conversion system of claim 6, wherein when the enabling valve is in the first enabled position, the enabling valve allows substantially unrestricted flow of hydraulic fluid therethrough and when the enabling valve is in the second position, the enabling valve allows a restricted flow of hydraulic fluid therethrough.

11. The power conversion system of claim 6, and further comprising an enabling valve actuation mechanism configured to shift the enabling valve between the disabled position, the first enabled position, and the second enabled position.

12. The power conversion system of claim 11, wherein the enabling valve actuation mechanism includes a biasing mechanism to bias the enabling valve to the disabled position.

13. The power conversion system of claim 11 and further comprising a control valve actuation mechanism for controlling a position of the control valve and wherein the enabling valve actuation mechanism is in communication with the control valve actuation mechanism.

* * * * *